US008299972B2

(12) United States Patent
Lai

(10) Patent No.: US 8,299,972 B2
(45) Date of Patent: Oct. 30, 2012

(54) ANTENNA FOR PORTABLE DEVICE

(75) Inventor: Chih-Hung Lai, Tu-Cheng (TW)

(73) Assignee: Chi Mei Communication Systems, Inc., Tu-Cheng, New Taipei (TW)

( * ) Notice: Subject to any disclaimer, the term of this patent is extended or adjusted under 35 U.S.C. 154(b) by 347 days.

(21) Appl. No.: 12/844,031

(22) Filed: Jul. 27, 2010

(65) Prior Publication Data

US 2011/0215980 A1 Sep. 8, 2011

(30) Foreign Application Priority Data

Mar. 2, 2010 (TW) ..... 99105997 A

(51) Int. Cl.
*H01Q 1/24* (2006.01)
*H01Q 1/38* (2006.01)

(52) U.S. Cl. ..... 343/702; 343/700 MS

(58) Field of Classification Search ..... 343/702, 343/700 MS, 770
See application file for complete search history.

(56) References Cited

U.S. PATENT DOCUMENTS

2010/0090912 A1* 4/2010 Lin et al. ..... 343/702
2011/0109515 A1* 5/2011 Rao ..... 343/702
2011/0156964 A1* 6/2011 Lin et al. ..... 343/702

* cited by examiner

*Primary Examiner* — Hoang V Nguyen
(74) *Attorney, Agent, or Firm* — Altis Law Group, Inc.

(57) ABSTRACT

The disclosure provides an antenna used for a portable device. The antenna includes a feed part, a ground part, a bent part, a main body, and an extended part. The main body connects with the feed part and the ground part. The main body further includes several gaps and slots so that the main body is divided into several radiating areas by the gaps and slots. The bent part is extended from the ground part. The extended part perpendicularly connects with the main body.

13 Claims, 3 Drawing Sheets

ANTENNA FOR PORTABLE DEVICE

BACKGROUND

1. Technical Field

The present disclosure relates to an antenna used for a portable device.

2. Description of Related Art

Portable devices such as mobile phones, personal digital assistants (PDA) and laptop computers are widely used. Antennas are installed in such portable devices to receive/send wireless signals. Generally, the antennas may receive/send wireless signals of different frequencies (e.g., DCS1800, PCS1900, UMTS2100, etc.), requiring that the antennas be multiband antennas.

However, most conventional multiband planar inverted F antennas (PIFAs) are unable to receive/send the signals of DCS1800 (bandwidths of about 1710 to 1880 MHz). Such antennas cannot satisfy requirements.

Therefore, there is room for improvement within the art.

BRIEF DESCRIPTION OF THE DRAWINGS

Many aspects of the present disclosure can be better understood with reference to the following drawings. The components in the various drawings are not necessarily drawn to scale, the emphasis instead being placed upon clearly illustrating the principles of the present disclosure. Moreover, in the drawings, like reference numerals designate corresponding parts throughout the figures.

DETAILED DESCRIPTION

Figure 1:
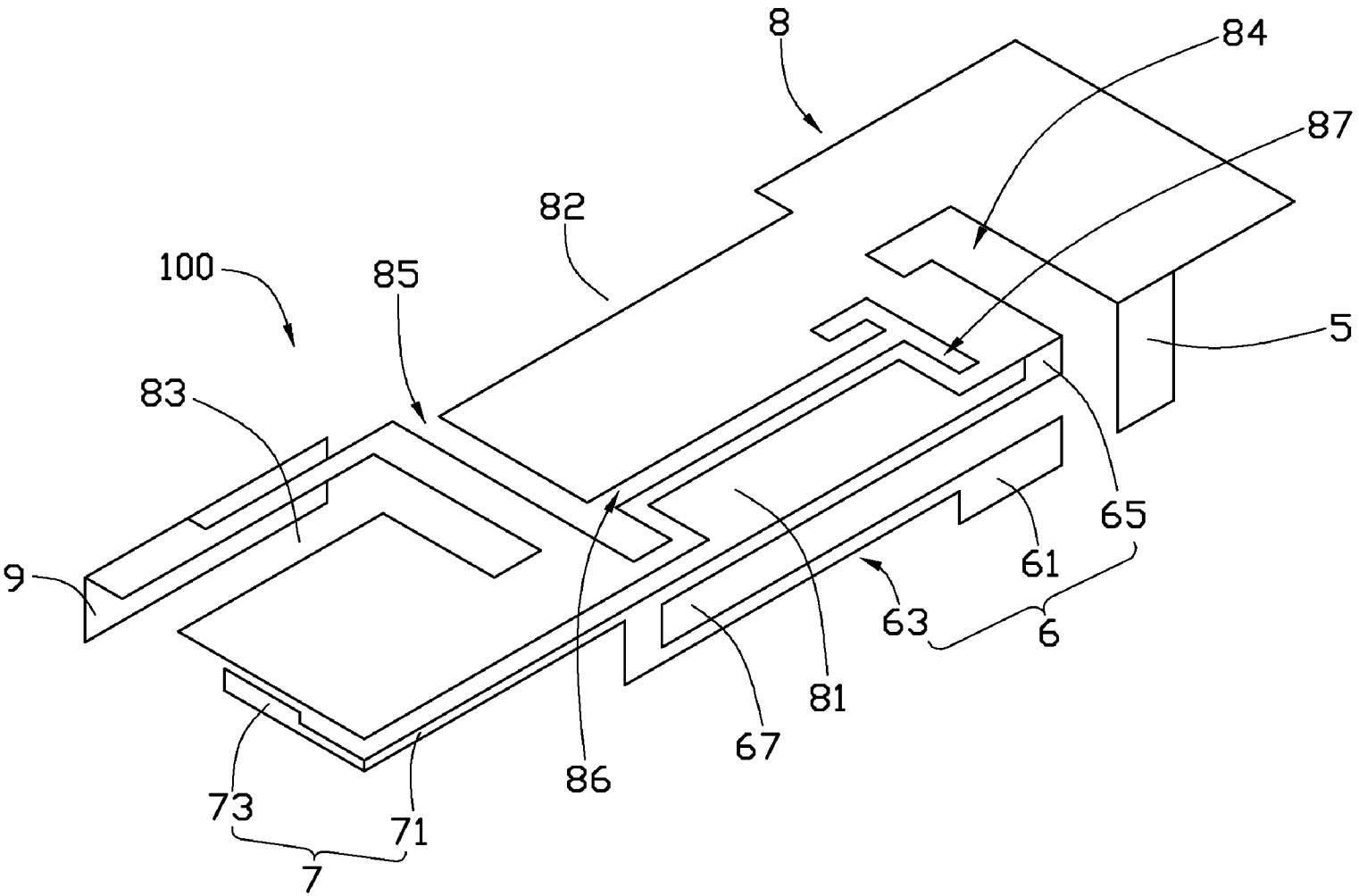
FIG. 1 is a schematic view of an antenna from a first perspective.

FIG. 1 is a schematic view of an antenna 100 from a first perspective. The antenna 100 is installed in a portable device (not shown) to receive/send wireless signals. The portable device may be a mobile phone, a personal digital assistant (PDA), or a laptop computer, for example. In the embodiment, the portable device is a mobile phone. The antenna 100 includes a feed part 5, a ground part 6, a bent part 7, a main body 8, and an extended part 9. The main body 8 connects with the feed part 5 and the ground part 6. The bent part 7 is extended from the ground part 6. The extended part 9 is rectangular and perpendicularly connects with the main body 8. In the exemplary embodiment, the dimensions of the antenna 100 are about 15 mm×50 mm×6 mm.

The feed part 5 is rectangular and electrically connects with a signal transmissive end of a printed circuit board (PCB) (not shown) of the portable device to feed the radio frequency signals. The ground part 6 includes a first ground section 61, a second ground section 63, and a third ground section 65. The first ground section 61 is rectangular and parallel to the feed part 5. The second ground section 63 connects with the first ground section 61 and the third ground section 65. The third ground section 65 is rectangular, and perpendicularly connects with the main body 8 and the second ground section 63.

Figure 2:
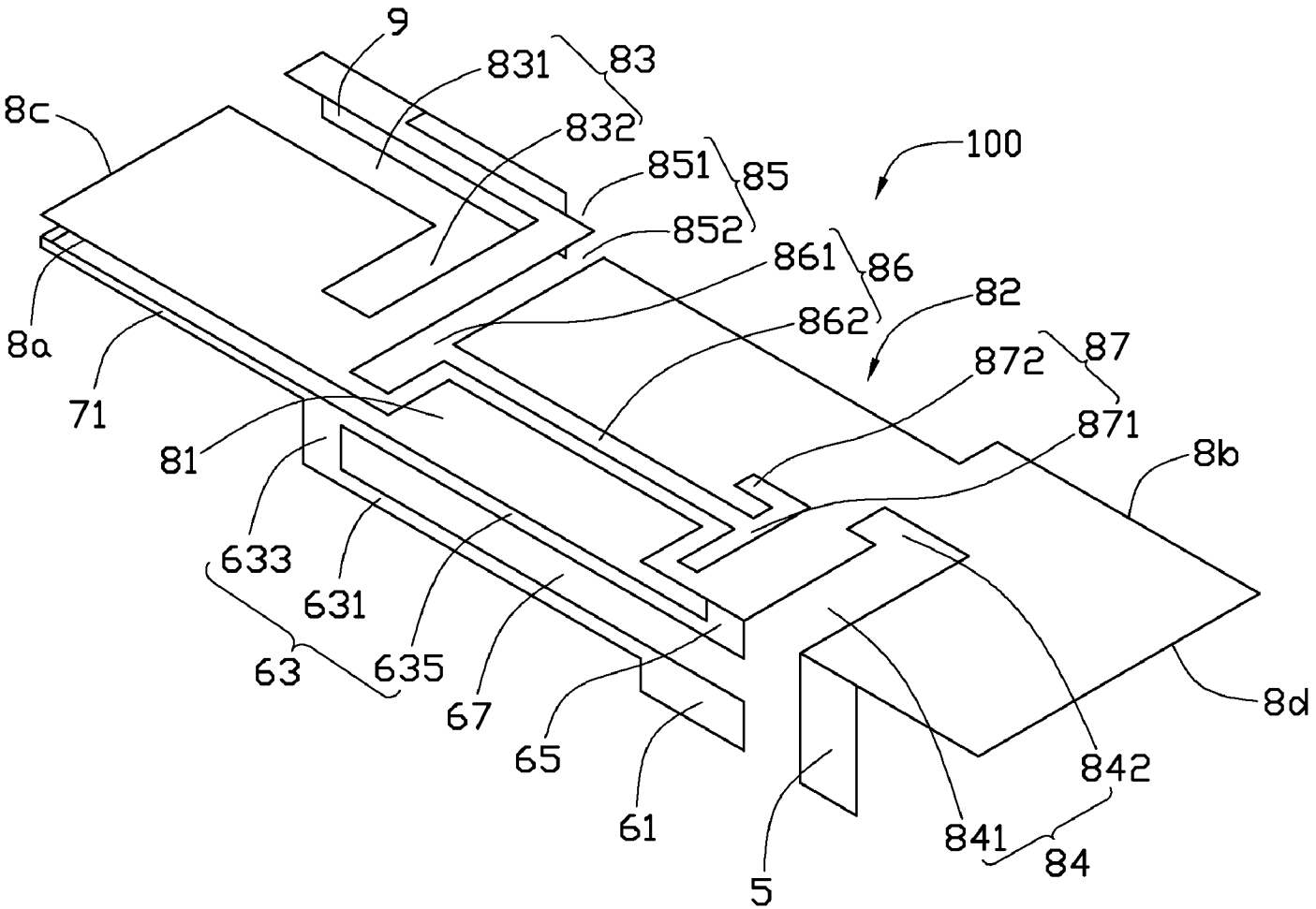
FIG. 2 is a schematic view of the antenna of FIG. 1 from a second perspective.

FIG. 2 is a schematic view of the antenna 100 of FIG. 1 from a second perspective. The second ground section 63 further includes a first long side 631, a short side 633, and a second long side 635. The first long side 631 is rectangular, and perpendicularly connects with the first ground section 61. The short side 633 is rectangular, and perpendicularly connects with the first long side 631. The second long side 635 is rectangular and parallel to the first long side 631, and perpendicularly connects with the short side 633. The first long side 631, the short side 633, and the second long side 635 jointly encircle a groove 67.

The bent part 7 includes a connecting section 71 and a bent section 73. The connecting section 71 is rectangular and extended from the second long side 635, and perpendicularly connects with the short side 633. The bent section 73 perpendicularly connects with the connecting section 71. The bent part 71 is configured to be a resonant path to receive or send signals having a higher frequency. In the exemplary embodiment, the bent part 71 is configured to receive/send the signals of DCS1800 (bandwidths of about 1710 to 1880 MHz).

The main body 8 includes a first long edge 8*a*, a second long edge 8*b*, a first short edge 8*c*, and a second short edge 8*d*. The first long edge 8*a* and the second long edge 8*b* are parallel. The first short edge 8*c* and the second short edge 8*d* are parallel, and perpendicular to the first long edge 8*a* and the second long edge 8*b*.

The main body 8 further includes a first gap 81, a second gap 82, a first slot 83, a second slot 84, a third slot 85, a fourth slot 86, and a fifth slot 87. The first gap 81 is rectangular and disposed on the middle of the first long edge 8*a* and the second gap 82 is rectangular and disposed on the middle of the second long edge 8*b*. The first gap 81 and the second gap 82 are parallel. The first slot 83 and the third slot 85 jointly define a radiation part on the main body 8 and the radiation part perpendicularly extends to form the extended part 9.

The first slot 83 includes a first space 831 and a second space 832. The first space 831 is disposed on the first short edge 8*c* and parallel to the first long edge 8*a* and the second long edge 8*b*. The second space 832 perpendicularly connects with the first space 831. The first space 831 and the second space 832 are both rectangular.

The second slot 84 is opposite to the first slot 83 and near to the second short edge 8*d*. The second slot 84 includes a third space 841 and a fourth space 842. The third space 841 is disposed on the first long edge 8*a*, and between the feed part 5 and the ground part 6. The fourth space 842 perpendicularly connects with the third space 841 and parallel to the first long edge 8*a* and the second long edge 8*b*. The third space 841 and the fourth space 842 are both rectangular.

The third slot 85 includes a fifth space 851 and a sixth space 852. The fifth space 851 is disposed on the second long edge 8*b* and connects with the second gap 82. The sixth space 852 perpendicularly connects with the fifth space 851 and the second gap 82, and is parallel to the first short edge 8*c* and the second short edge 8*d*. The fifth space 851 and the sixth space 852 are both rectangular.

The fourth slot 86 includes a seventh space 861 and an eighth space 862. The seventh space 861 is extended from the sixth space 852 to approach the first long edge 8*a*. The eighth space 862 perpendicularly connects with the sixth space 852 and the seventh space 861, and parallel to the first long edge 8*a* and the second long edge 8*b*. The seventh space 861 and the eighth space 862 are both rectangular.

The fifth slot 87 includes a ninth space 871 and a tenth space 872. The ninth space 871 perpendicularly connects with the eighth space 862, and parallel to the first short edge 8*c* and the second short edge 8*d*. The tenth space 872 is perpendicularly extended from the ninth space 871. The ninth space 871 and the tenth space 872 are both rectangular.

The main body 8 is divided into several radiating areas by the first gap 81, the second gap 82, the first slot 83, the second slot 84, the third slot 85, the fourth slot 86, and the fifth slot 87. When the antenna 100 is in operation, the radio frequency signals feed into the feed part 5 and pass through the several radiating areas. As a result, the antenna 100 may generate signals of different bandwidths at different communication standards, GSM900 (bandwidths of about 890 to 960 MHz), DCS1800 (bandwidths of about 1710 to 1880 MHz), PCS1900 (bandwidths of about 1850 to 1990 MHz), and WCDMA2100 (bandwidths of about 1920 to 2170 MHz).

Figure 3:
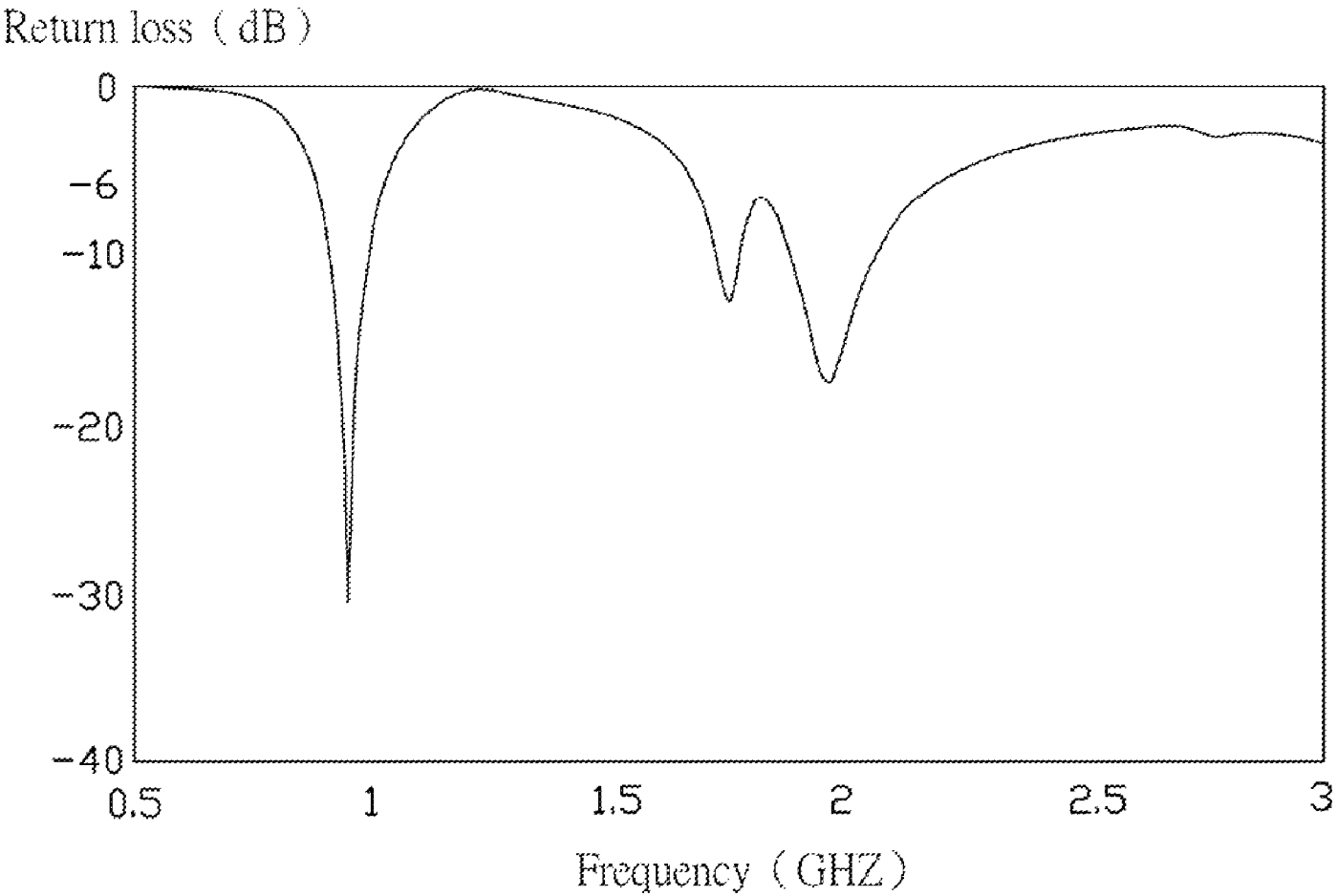
FIG. 3 is a measurement diagram of return loss of the antenna of FIG. 1.

FIG. 3 is a measurement diagram of return loss of the antenna 100 of FIG. 1. The values of return loss are −6.023 db, −6.056 db, −6.024 db, −6.69 db, and −6.035 db corresponding to 884 MHz, 1024 MHz, 1679 MHz, 1813 MHz, and 2173 MHz satisfying the communication standards.

It is to be further understood that even though numerous characteristics and advantages of the present embodiments have been set forth in the foregoing description, together with details of structures and functions of various embodiments, the disclosure is illustrative only, and changes may be made in detail, especially in matters of shape, size, and arrangement of parts within the principles of the present invention to the full extent indicated by the broad general meaning of the terms in which the appended claims are expressed.

What is claimed is:

1. An antenna, comprising:
- a feed part;
- a ground part;
- a main body connecting with the feed part and the ground part, comprising a first gap, a second gap, a first slot, a second slot, a third slot, a fourth slot, and a fifth slot;
- a bent part extended from the ground part, the bent part is operable to be a resonant path; and
- an extended part perpendicularly connecting with the main body.

2. The antenna of claim 1, wherein the ground part comprises:
- a first ground section parallel to the feed part;
- a second ground section;
- a third ground section perpendicularly connecting with the main body and the second ground section; and
- wherein the second ground section connecting with the first ground section and the third ground section.

3. The antenna of claim 2, wherein the second ground section comprises:
- a first long side perpendicularly connecting with the first ground section;
- a short side perpendicularly connecting with the first long side; and
- a second long side parallel to the first long side and perpendicularly connecting with the short side.

4. The antenna of claim 3, wherein the first long side, the short side, and the second long side jointly encircle a groove.

5. The antenna of claim 3, wherein the bent part comprises:
- a connecting section extended from the second long side and perpendicularly connecting with the short side; and
- a bent section perpendicularly connecting with the connecting section.

6. The antenna of claim 5, wherein the main body further comprises:
- a first long edge and a second long edge parallel; and
- a first short edge and a second short edge parallel, and perpendicular to the first long edge and the second long edge.

7. The antenna of claim 6, wherein the first gap is disposed on the first long edge and the second gap is disposed on the second long edge.

8. The antenna of claim 6, wherein the first slot comprises:
- a first space disposed on the first short edge and parallel to the first long edge and the second long edge; and
- a second space perpendicularly connecting with the first space.

9. The antenna of claim 8, wherein the second slot is opposite to the first slot and comprises:
- a third space disposed on the first long edge, and between the feed part and the ground part; and
- a fourth space perpendicularly connecting with the third space and parallel to the first long edge and the second long edge.

10. The antenna of claim 9, wherein the third slot comprises:
- a fifth space disposed on the second long edge and connecting with the second gap; and
- a sixth space perpendicularly connecting with the fifth space and the second gap, and parallel to the first short edge and the second short edge.

11. The antenna of claim 10, wherein the fourth slot comprises:
- a seventh space extending from the sixth space to approach the first long edge; and
- an eighth space perpendicularly connecting with the sixth space and the seventh space, and parallel to the first long edge and the second long edge.

12. The antenna of claim 11, wherein the fifth slot comprises:
- a ninth space perpendicularly connecting with the eighth space, and parallel to the first short edge and the second short edge; and
- a tenth space perpendicularly extending from the ninth space.

13. The antenna module of claim 12, wherein the first slot and the third slot jointly define a radiation part on the main body and the radiation part perpendicularly extends to form the extended part.

* * * * *